US007392917B2

(12) United States Patent
Alalu et al.

(10) Patent No.: US 7,392,917 B2
(45) Date of Patent: Jul. 1, 2008

(54) ROLL OF DISPOSABLE PIECES OF HYGIENIC PAPER

(76) Inventors: Avraham Alalu, Emek Israel 48, Bnei Brak (IL); Gideon Sasonoff, Bosem 46, Tel Aviv (IL)

( * ) Notice: Subject to any disclaimer, the term of this patent is extended or adjusted under 35 U.S.C. 154(b) by 250 days.

(21) Appl. No.: 11/271,891

(22) Filed: Nov. 14, 2005

(65) Prior Publication Data

US 2007/0125902 A1 Jun. 7, 2007

(51) Int. Cl.
*B65H 1/04* (2006.01)

(52) U.S. Cl. ..... 221/48; 242/597.8

(58) Field of Classification Search ..... 242/597, 242/597.8; 221/48, 49; 271/216
See application file for complete search history.

(56) References Cited

U.S. PATENT DOCUMENTS 2,417,497 A * 3/1947 Hulslander, Sr. ..... 206/390
5,609,269 A * 3/1997 Behnke et al. ..... 221/48
5,762,285 A * 6/1998 Lin ..... 242/565
6,554,158 B2 * 4/2003 Kapiloff et al. ..... 221/277
6,786,377 B1 * 9/2004 Holden ..... 225/106
6,805,271 B2 * 10/2004 Holden ..... 225/106
7,090,106 B2 * 8/2006 Holden ..... 225/106

FOREIGN PATENT DOCUMENTS

JP 2005-204868 * 8/2005

* cited by examiner

*Primary Examiner*—William A Rivera
(74) *Attorney, Agent, or Firm*—Mark M. Friedman

(57) ABSTRACT

A roll of disposable pieces of hygienic paper from which pieces of hygienic paper can be removed with one hand without any need for tearing or cutting the hygienic paper, including an inner tube of a rigid material onto which pieces of hygienic paper are wound with partial overlapping between themselves. Pulling the next piece of hygienic paper in turn causes rotation of the roll of pieces of paper and easy removal of the piece from it. The roll of disposable pieces of hygienic paper can be assembled to a dispenser for carrying and use as well as a dispenser designed especially for the roll with means of exerting an adduction force on the roll.

8 Claims, 4 Drawing Sheets

ROLL OF DISPOSABLE PIECES OF HYGIENIC PAPER

FIELD AND BACKGROUND OF THE INVENTION

The present invention relates to rolls of disposable pieces of hygienic paper, and in particular to rolls of toilet paper and paper towels that enable removal of a piece of paper for use without needing to tear the paper prior to use. Paper is used in many forms for single-time hygienic purposes. There is a wide variety of packaging of paper towels, ranging from a simple roll of paper towels to high-quality moist towelettes in packages that enable removal of a single towelette at a time. These packages are inefficient when they do not prevent unwanted unraveling of the towelettes or are expensive. However, the packaging of hygienic paper in a long strip of paper rolled onto itself with perforated lines at regular intervals in order to facilitate tearing off pieces of paper for wiping, which are disposed of after use, is the most common type of hygienic paper currently available Such rolls of paper can be found in dispensers of suitable sizes such as toilet paper dispensers in toilet rooms and paper towel dispensers near washbowls. Many efforts have been made to develop paper of superior qualities, which are sometimes even contradictory, such as paper strength, dimensions, softness, wiping and absorption capacity, and manufacturing cost.

FIG. 1 is a schematic illustration of the prior art that illustrates a roll of toilet paper 100 in a standard toilet paper dispenser 101. The roll of paper 100 includes toilet paper 10, which has perforated lines 11 at regular intervals that enable tearing at the desired places. The toilet paper is a long continuous strip, long in comparison to its width, rolled onto an inner tube 12. As shown in the illustration, the inner tube 12 is disposed on an arm 13 with a round section, which is part of the toilet paper dispenser 101. When pulling the toilet paper in order to expose a segment of paper to be torn, this arrangement enables the toilet paper roll 100 to rotate around the arm 13.

FIG. 2 is a schematic illustration of the prior art that illustrates a continuous hygienic toilet paper roll 102 above which a cutting apparatus 20 is disposed. This roll can perforated lines across its width however this is not necessary seeing as the tearing of the paper 14 is performed by suitably pulling the paper 14 strongly towards the cutting apparatus, which is usually of a heavy and rigid metallic material that could include a cutting knife or saw teeth 21 as shown in the illustration.

In many cases, the standard packaging of continuous paper in a roll of which pieces can be torn for use is inconvenient or even impossible to use. Seeing as the tearing of the paper in the desired places requires use of both hands, use of such rolls by disabled individuals who are unable to use one hand or individuals with disability with regard to combined use of both hands for this purpose.

Use of such rolls of continuous paper is also problematic for observant Jews, seeing as according to the laws of Judaism, tearing of paper is prohibited during the Shabbat and on holidays.

There is thus a widely recognized need for, and it would be highly advantageous to have, a roll of hygienic paper with the same qualities that have made prior art toilet paper popular and with an additional quality that enables removal of pieces of hygienic paper from it with only one hand without any need for tearing.

SUMMARY OF THE INVENTION

It is an object of the present invention to provide rolls of hygienic paper that enable removal of pieces of hygienic paper with one hand and without any need for tearing. According to the present invention, the roll of hygienic paper includes pre-cut pieces of paper in adequate sizes for their purpose. These pieces of paper are packed around an inner tube when each piece of paper overlaps with the next piece above it (namely, at a relative distance with regard to the central axis of the inner tube, that is approximately the thickness of the hygienic paper) as necessary to enable packaging of all the pieces and removing them in turn, one after the other.

According to further features in preferred embodiments of the invention, a roll of disposable pieces of hygienic paper from which pieces of hygienic paper can be removed with one hand without any need for tearing or cutting the hygienic paper including: (a) an inner tube of a rigid material with a symmetry axis and external radius and height dimensions such that the section of the inner tube perpendicular to the symmetry axis is substantially round for the entire height; and (b) at least two pieces of hygienic paper with a surface and thickness, width, and length dimensions deployed so as to synchronously rotate the roll of disposable pieces of hygienic paper when one the piece of hygienic paper is removed, with the pieces of hygienic paper packed onto the inner tube and onto themselves such that: (i) each of the pieces of hygienic paper has a cylindrical shape, with a spiral section around the symmetry axis of the inner tube; (ii) all of the pieces of hygienic paper are substantially packed to be fully overlapping in the width dimension of each piece; and (iii) each of the pieces of hygienic paper is substantially packed to be partially overlapping in its length dimension with regard to each adjacent piece of hygienic paper that it is in contact with.

According to still further features in the described preferred embodiments the pieces of hygienic paper are packed by outward rolling.

According to still further features in the described preferred embodiments the pieces of hygienic paper are packed by inward rolling.

According to another embodiment of the invention a dispenser, for holding and using a roll of disposable pieces of hygienic paper, from which pieces of hygienic paper can be removed, using one hand without any need for tearing or cutting the hygienic paper including: (a) a roll of disposable pieces of hygienic paper, the roll of disposable pieces of hygienic paper including: (i) an inner tube of a rigid material with a symmetry axis and external radius and height dimensions such that the section of the inner tube perpendicular to the symmetry axis is substantially round for the entire height; and (ii) at least two pieces of hygienic paper with a surface and thickness, width, and length dimensions deployed so as to synchronously rotate the roll of disposable pieces of hygienic paper when one piece of hygienic paper is removed, with the pieces of hygienic paper packed onto the inner tube and onto themselves such that: (A) each of the pieces of hygienic paper has a cylindrical shape, with a spiral section around the symmetry axis of the inner tube; (B) all of the pieces of hygienic paper are substantially packed to be fully overlapping in the width dimension of each piece; and (C) each of the pieces of hygienic paper is substantially packed to be partially overlapping in its length dimension with regard to each adjacent piece of hygienic paper that it is in contact with; (b) an arm for carrying the roll of disposable pieces of hygienic paper with the inner tube assembled to the carrying arm whose dimensions enable the roll of disposable pieces of hygienic paper to have rotational movement; and (c) a means of exerting an adduction force on at least part of the surface of the piece of hygienic paper that is in an external location on the roll of disposable pieces of hygienic paper.

According to still further features in the described preferred embodiments the dispenser, for holding and using a roll of disposable pieces of hygienic paper, from which pieces of hygienic paper can be removed using one hand without any need for tearing or cutting the hygienic paper, wherein the means of exerting an adduction force is a cylindrical weight capable of rotating around an axis.

According to still further features in the described preferred embodiments the dispenser, for holding and using a roll of disposable pieces of hygienic paper, from which pieces of hygienic paper can be removed using one hand without any need for tearing or cutting the hygienic paper, wherein the means of exerting an adduction force is a spring exerting force on the carrying arm.

According to the present invention, a method is provided, including the steps of: (a) providing a roll of disposable pieces of hygienic paper, the roll of disposable pieces of hygienic paper including: (i) an inner tube of a rigid material with a symmetry axis and external radius and height dimensions such that the section of the inner tube perpendicular to the symmetry axis is substantially round for the entire height; and (ii) at least two pieces of hygienic paper with a surface and thickness, width, and length dimensions deployed so as to synchronously rotate the roll of disposable pieces of hygienic paper when one piece of hygienic paper is removed, with the pieces of hygienic paper packed onto the inner tube and onto themselves such that; (A) each of the pieces of hygienic paper has a cylindrical shape, with a spiral section around the symmetry axis of the inner tube; (B) all of the pieces of hygienic paper are substantially packed to be fully overlapping in the width dimension of each piece; and (C) each of the pieces of hygienic paper is substantially packed to be partially overlapping in its length dimension with regard to each adjacent piece of hygienic paper that it is in contact with; (b) installing the roll of disposable pieces of hygienic paper in a dispenser, for holding and using a roll of hygienic paper; and (c) removing a piece of paper from the roll of disposable pieces of hygienic paper.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
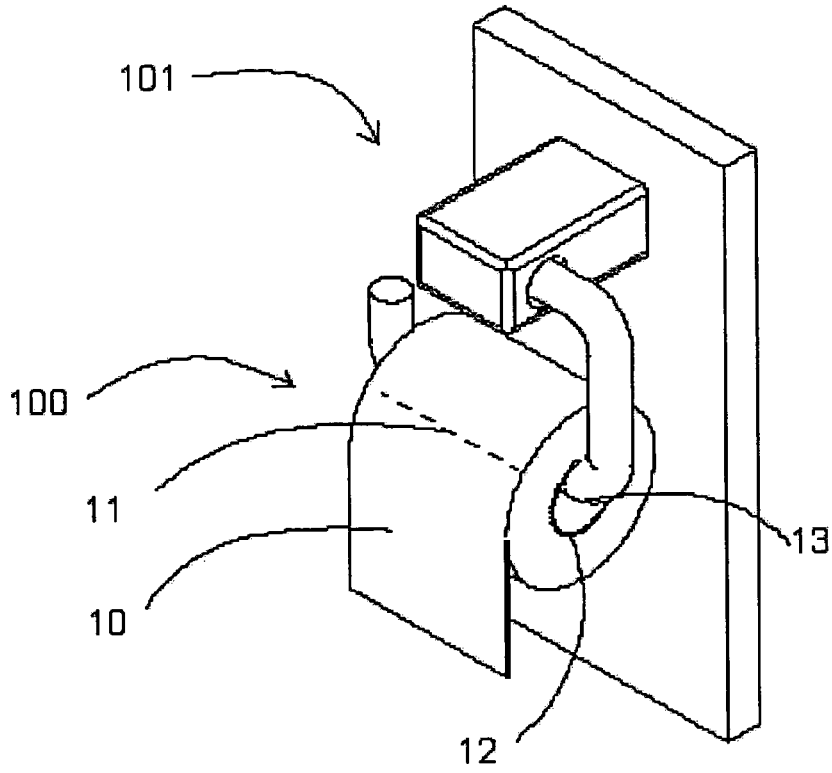
FIG. 1 PRIOR ART
FIG. 1 is a schematic illustration of the prior art showing a roll of toilet paper in a standard toilet paper dispenser.
Figure 2:
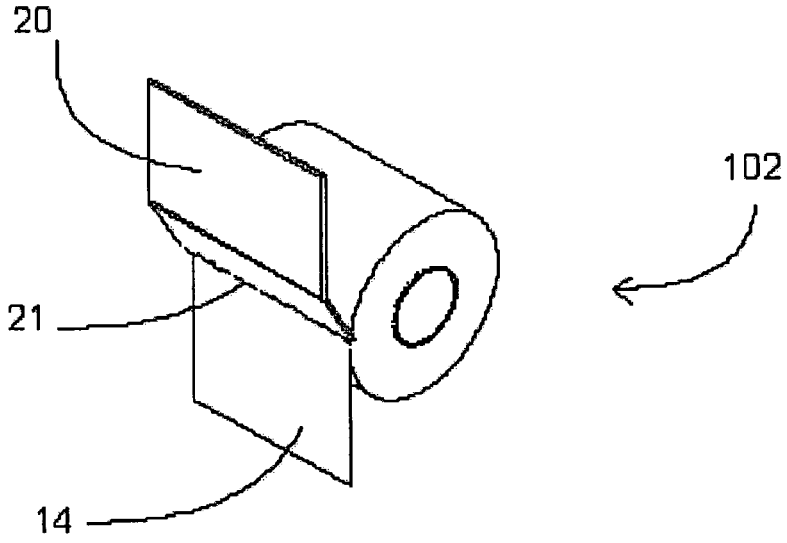
FIG. 2 PRIOR ART
FIG. 2 is a schematic illustration of the prior art showing a continuous roll of hygienic paper above which a cutting apparatus is disposed.

The present invention is a roll of hygienic paper and, in particular a roll containing pieces of disposable hygienic paper that enables removal of pieces of paper from it without any need for tearing or cutting the paper. Tests conducted on this roll of hygienic paper according to preferred embodiments of the present invention show that the invention meets the need it comes to serve well.

The principles and operation of a roll of disposable pieces of hygienic paper according to the present invention may be better understood with reference to the drawings and the accompanying descriptions.

Before explaining at least one embodiment of the invention in detail, it is to be understood that the invention is not limited in its application to the details of construction and the arrangement of the components set forth in the following description or illustrated in the drawings.

Unless otherwise defined, all technical and scientific terms used herein have the same meaning as commonly understood by one of ordinary skill in the art to which this invention belongs. The materials, dimensions, methods, and examples provided herein are illustrative only and are not intended to be limiting.

Figure 3A:
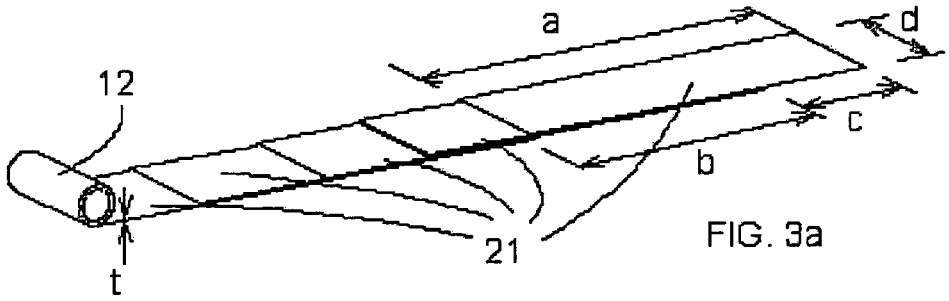
FIG. 3*a* and FIG. 3*b* are schematic illustrations of stages in the process of production of a roll of disposable pieces of hygienic paper according to a preferred embodiment of the present invention.

Referring now to the drawings, FIG. 3*a* is a schematic illustration of a stage in the production of the roll of disposable pieces of hygienic paper according to a preferred embodiment of the present invention. Pieces of paper 21 are placed overlapping one another on a plane and are then gathered by rolling onto an inner tube 12 into one package as a roll 200, as will be described in the following. The inner tube 12 can be of various materials including cardboard. Each piece of paper 21 that is designated to serve as hygienic paper has geometric dimensions. The thickness is marked by the letter "t", the width by the letter "d", and the length by the letter "a". The length of the overlapping section is marked by the letter "b", with the overlapping of the paper 21 consistent over all of its width "d". The length of the end of the paper 21 without overlapping is marked by the letter "c" and can later serve for a convenient grasp between the users fingers for being pulled out of the roll 200. The piece of paper 21 can have one or more lines of perforations 11 similar to those shown in FIG. 1, or can be without any perforations at all. As shown in this illustration, the pieces of paper are placed one above the other with a deviation of "c" between each piece so that the farther the piece is from the inner tube 12, the higher the layer that it is in. This arrangement results in the packaging of the roll of disposable pieces of hygienic paper 200 as described in all items of this application including the specifications and claims as inward rolling packaging.

Figure 3B:
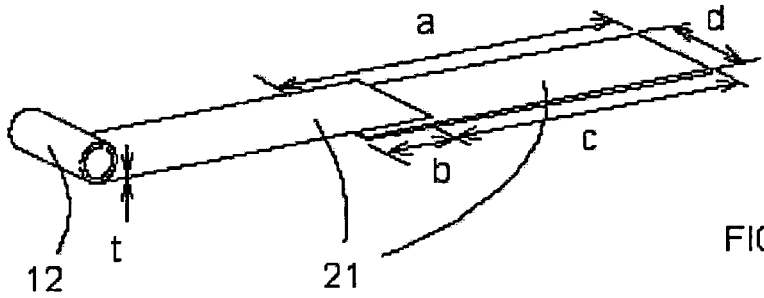

FIG. 3*b* is a schematic illustration of a stage in the production of the roll of disposable pieces of hygienic paper according to another preferred embodiment of the present invention. This stage is identical to the one described in FIG. 3*a* other than the arrangement of pieces of paper 21, such that the farther the piece is from the inner tube 12, the lower the layer that it is in. This arrangement results in the packaging of the roll of pieces of disposable hygienic paper 200 as described in all items of this application including the specifications and claims as outward rolling packaging.

Both inward rolling packaging and outward rolling packaging can have an approximately equal measure of overlapping throughout the entire roll 200 or can have differing measures of overlapping according to the location of each piece of paper 21 in the roll 200. The size of the pieces of paper 21 and the measures of overlapping between pieces can be determined according to testing.

Figure 4:
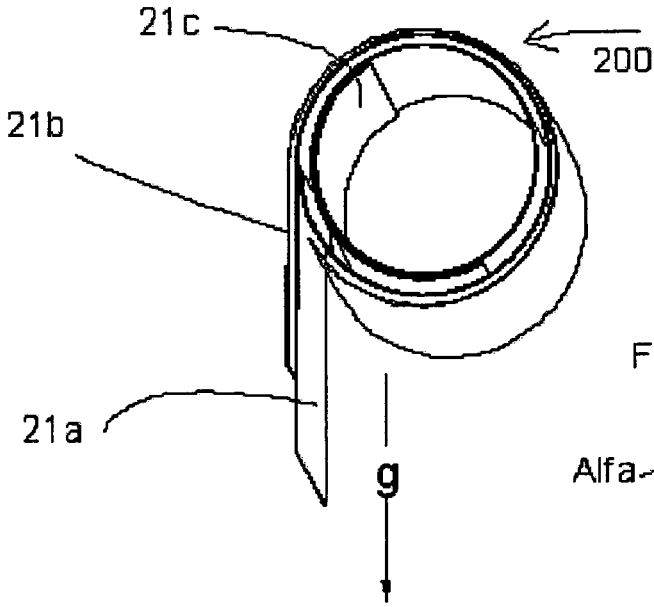
FIG. 4 is a schematic illustration of several external pieces of a roll of disposable pieces of hygienic paper according to a preferred embodiment of the present invention.

FIG. 4 is a schematic illustration of several external pieces of paper 21 in a roll of disposable pieces of hygienic paper 200 according to a preferred embodiment of the present invention in inward rolling packaging. The direction of gravity force is marked in the illustration by the letter "g". As shown in the illustration, the piece of paper 21*c* has an almost circular shape when viewed from the side, when a piece of paper 21*a* is wound one layer above it, and a piece of paper 21*b* is wound in an additional layer. A certain segment of each of the pieces 21*a* and 21*b* is hung over the roll 200 on planes according to gravity force. The length of this segment depends upon the momentary rotational angle of the roll 200 with regard to its central axis. The next piece of paper in turn to be removed is the one whose hanging length is the longest, and in the instance shown in this illustration, is the piece of paper 21*a*. Pulling the next piece of paper in turn approximately downwards or in any other suitable direction causes a rotational movement of the roll 200 around its axis until the next piece of paper in turn is removed.

Figure 5:
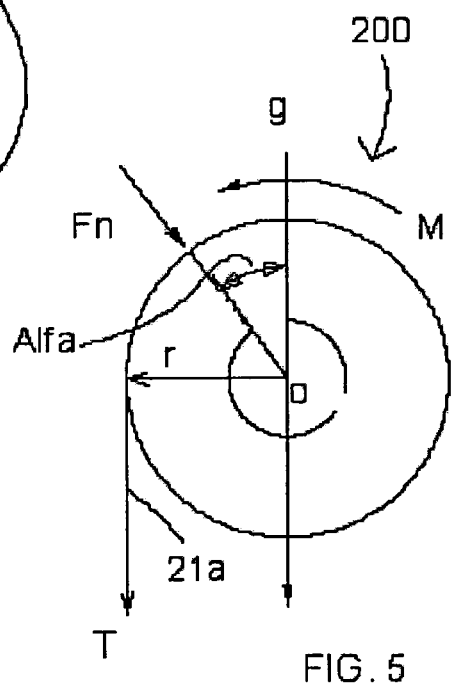
FIG. 5 is a schematic illustration of the forces and moments exerted upon the roll of disposable pieces of hygienic paper.

FIG. 5 is a schematic illustration of a side view of the forces and moments exerted on the roll of disposable pieces of hygienic paper 200, on a perpendicular plane with regard to the axis. When pulling force T is exerted on the next piece of paper in turn 21*a*, moment force M is generated, causing the rotational movement of the roll 200 around its central axis through point O. The magnitude of moment M depends on the magnitude of force T and the external radius r of the roll. This is on the condition that there is no sliding motion between the piece of paper 21*a* and the roll 200. In order to prevent this sliding motion, piece of paper 21*a* needs to exert the essential moment M on the roll 200 that will rotate it in a velocity correspondent to the pulling motion. There are several kinds of forces which paper 21*a* can exert on the roll 200, including electrostatic forces and adhesive forces, however the main force is the friction force whose size depends on the friction coefficient and the normal force, perpendicular to the roll 200 at all points of contact with the paper 21*a*. The illustration shows normal force Fn exerted on the point at Alpha angle with regard to the gravitational axis. Normal forces of various sizes can be exerted in the entire area of contact between the next piece of paper in turn to be pulled 21*a* and the roll 200, and all are effectively exerted at radius r from the center of the roll 200. The integration of these forces determines the size of moment M. A primary source of normal forces is the gravity of the pieces of paper 21 themselves.

Figure 6:
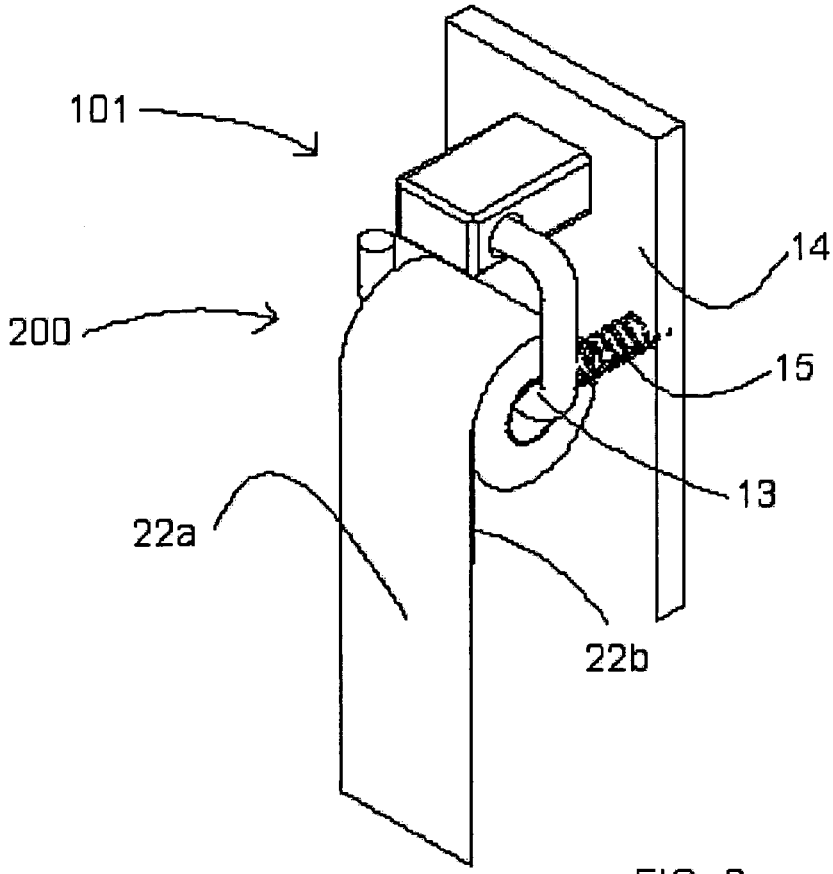
FIG. 6 is a schematic illustration of the roll of disposable pieces of hygienic paper according to a preferred embodiment of the present invention, which is disposed in a standard toilet paper dispenser that is equipped with a spring designated to increase the normal force exerted on the roll.

FIG. 6 is a schematic illustration of the roll of disposable pieces of hygienic paper 200 according to a preferred embodiment of the present invention, disposed in a standard toilet paper dispenser 101 equipped with a spring 15 designated to increase the normal force exerted on the roll 200. The spring 15 is connected between the base of the dispenser 14 and the arm 13, as described in FIG. 1. The advantage of increasing the normal force exerted on the roll 200, is that it enables use of hygienic pieces of paper 21 of length a, as shown in FIGS. 3*a* and 3*b*, which is smaller that what would be required in the case of a smaller normal force.

Figure 7:
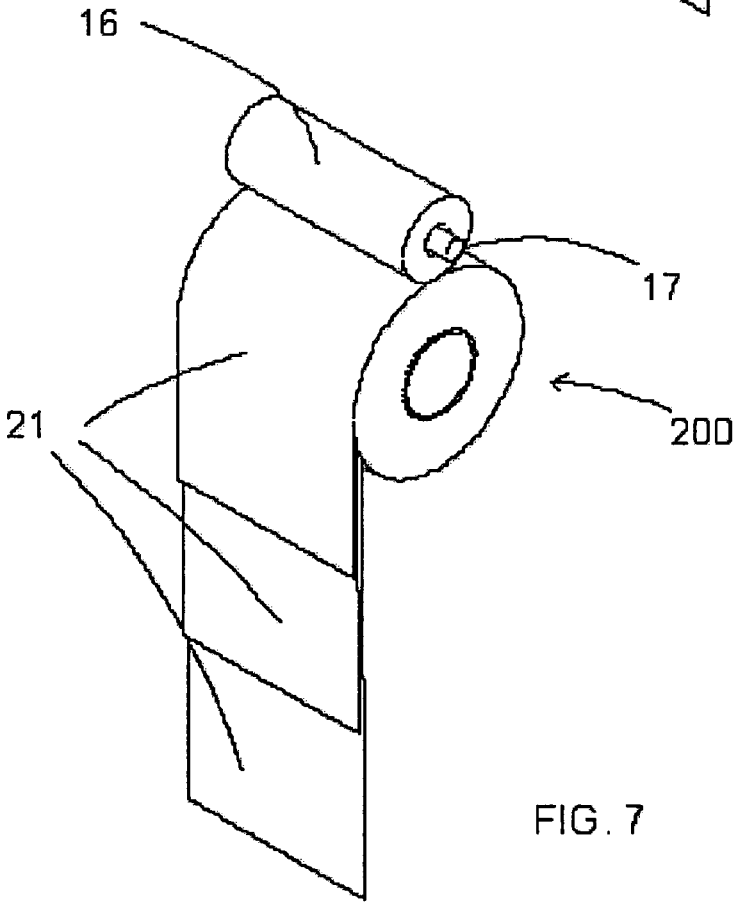
FIG. 7 is a schematic illustration of the roll of disposable pieces of hygienic paper according to a preferred embodiment of the present invention, upon which a weight is placed to increase the normal force.

FIG. 7 is a schematic illustration of the roll of disposable pieces of hygienic paper 200 according to a preferred embodiment of the present invention, on which a weight is disposed to increase the normal force. The benefit of adding the weight is similar to the explanation on the normal force exerted on the roll 200 given with regard to FIG. 6. In the present case, the weight is closer to the location at which the pieces of paper are disconnected from the roll 200, enabling use of even shorter pieces of hygienic paper 21. The weight that is described in this illustration is cylindrical 16 on an axis whose distance from the central axis of the roll 200 is determined according to the changing radius of the roll 200, a radius that decreases in size as the pieces of paper 21 are consumed. The capability of the cylindrical weight 16 to rotate around it axis enables better rotational movement of the roll 200 without the weight interfering with the movement of the pieces of paper 21.

The apparatuses for increasing the normal force as described in FIGS. 6 and 7 are good for both inward rolling packaging and outward rolling packaging.

Figure 8:
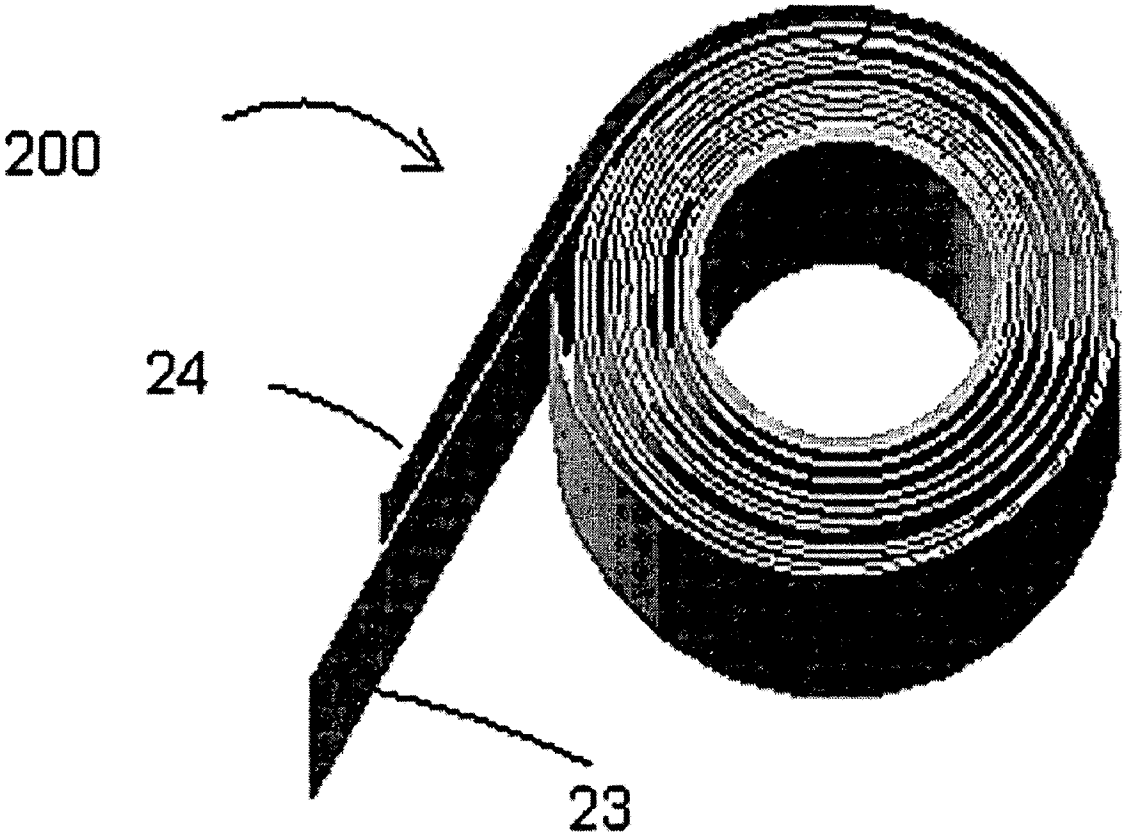
FIG. 8 is a schematic illustration of the roll of disposable pieces of hygienic paper according to a preferred embodiment of the present invention, packaged by inward rolling.

FIG. 8 is a schematic illustration of the roll of disposable pieces of hygienic paper 200, according to a preferred embodiment of the present invention, in inward rolling packaging. The illustration shows the piece of hygienic paper in turn 23 that will be the first piece to be pulled and removed from the roll 200 and the second piece 24 following in turn.

As shown in testing, both inward rolling and outward rolling packaging have the qualities necessary to fill the need that the present invention comes to fulfill. Simple testing can determine all of the qualities of the roll of disposable pieces of hygienic paper, including the geometrical dimensions of each piece of paper, the geometrical dimensions of the roll of disposable pieces of hygienic paper, and the materials and textures composing the pieces of hygienic paper.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A roll of disposable pieces of hygienic paper from which pieces of hygienic paper can be removed with one hand without any need for tearing or cutting said hygienic paper comprising:

(a) an inner tube of a rigid material with a symmetry axis and external radius and height dimensions such that the section of the inner tube perpendicular to said symmetry axis is substantially round for the entire said height; and (b) at least two pieces of hygienic paper with a surface and thickness, width, and length dimensions deployed so as to synchronously rotate said roll of disposable pieces of hygienic paper when one of said piece of hygienic paper is removed, with said pieces of hygienic paper packed onto said inner tube and onto themselves such that:

(i) each of said piece of hygienic paper has a cylindrical shape, with a spiral section around the symmetry axis of the inner tube;

(ii) all of said pieces of hygienic paper are substantially packed to be fully overlapping in said width dimension of each piece; and (iii) each of said pieces of hygienic paper is substantially packed to be partially overlapping in its length dimension with regard to each adjacent said piece of hygienic paper that it is in contact with.

2. The roll of disposable pieces of hygienic paper of claim 1, wherein said pieces of hygienic paper are packed by outward rolling.

3. The roll of disposable pieces of hygienic paper of claim 1, wherein said pieces of hygienic paper are packed by inward rolling.

4. A dispenser, for holding and using a roll of disposable pieces of hygienic paper, from which pieces of hygienic paper can be removed using one hand without any need for tearing or cutting said hygienic paper comprising:

(a) a roll of disposable pieces of hygienic paper said roll of disposable pieces of hygienic paper including:

(i) an inner tube of a rigid material with a symmetry axis and external radius and height dimensions such that the section of said inner tube perpendicular to said symmetry axis is substantially round for the entire height; and (ii) at least two pieces of hygienic paper with a surface and thickness, width, and length dimensions deployed so as to synchronously rotate said roll of disposable pieces of hygienic paper when one of said piece of hygienic paper is removed, with said pieces of hygienic paper packed onto said inner tube and onto themselves such that:

(A) each of said pieces of hygienic paper has a cylindrical shape, with a spiral section around said symmetry axis of said inner tube;

(B) all of said pieces of hygienic paper are substantially packed to be fully overlapping in said width dimension of each piece; and (C) each of said pieces of hygienic paper is substantially packed to be partially overlapping in its length dimension with regard to each adjacent said piece of hygienic paper that it is in contact with;

(b) an arm for carrying said roll of disposable pieces of hygienic paper with said inner tube assembled to said carrying arm whose dimensions enable said roll of disposable pieces of hygienic paper to have rotational movement; and (c) a means of exerting an adduction force on at least part of said surface of said piece of hygienic paper that is in an external location on said roll of disposable pieces of hygienic paper.

5. The dispenser of claim 4, for holding and using a roll of disposable pieces of hygienic paper, from which pieces of hygienic paper can be removed using one hand without any need for tearing or cutting said hygienic paper, wherein said means of exerting an adduction force is a cylindrical weight capable of rotating around an axis.

6. The dispenser of claim 4, for holding and using a roll of disposable pieces of hygienic paper, from which pieces of hygienic paper can be removed using one hand without any need for tearing or cutting said hygienic paper, wherein said means of exerting an adduction force is a spring exerting force on said carrying arm.

7. A method of using a roll of disposable pieces of hygienic paper, comprising the steps of:

(a) providing a roll of disposable pieces of hygienic paper said roll of disposable pieces of hygienic paper including:

(i) an inner tube of a rigid material with a symmetry axis and external radius and height dimensions such that the section of said inner tube perpendicular to said symmetry axis is substantially round for the entire height; and (ii) at least two pieces of hygienic paper with a surface and thickness, width, and length dimensions deployed so as to synchronously rotate said roll of disposable pieces of hygienic paper when one said piece of hygienic paper is removed, with said pieces of hygienic paper packed onto said inner tube and onto themselves such that;

(A) each of said pieces of hygienic paper has a cylindrical shape, with a spiral section around said symmetry axis of said inner tube;

(B) all of said pieces of hygienic paper are substantially packed to be fully overlapping in said width dimension of each piece; and (C) each of said pieces of hygienic paper is substantially packed to be partially overlapping in its length dimension with regard to each adjacent of said piece of hygienic paper that it is in contact with;

(b) installing said roll of disposable pieces of hygienic paper in a dispenser, for holding and using a roll of hygienic paper; and (c) removing a piece of paper from said roll of disposable pieces of hygienic paper.

8. A roll of disposable separated pieces of hygienic paper from which pieces of hygienic paper can be removed with one hand without any need for tearing or cutting said hygienic paper comprising:

(a) an inner tube of a rigid material with a symmetry axis and external radius and height dimensions such that the section of the inner tube perpendicular to said symmetry axis is substantially round for the entire said height; and (b) at least two separated pieces of hygienic paper with a surface and thickness, width, and length dimensions deployed so as to synchronously rotate said roll of disposable separated pieces of hygienic paper when one of said pieces of hygienic paper is removed, with said separated pieces of hygienic paper packed onto said inner tube and onto themselves such that:

(i) each of said piece of hygienic paper has a cylindrical shape, with a spiral section around the symmetry axis of the inner tube;

(ii) all of said pieces of hygienic paper are substantially packed to be fully overlapping in said width dimension of each piece; and (iii) each of said pieces of hygienic paper is substantially packed to be partially overlapping in its length dimension with regard to each adjacent said piece of hygienic paper that it is in contact with.

* * * * *

US007392917C1

(12) EX PARTE REEXAMINATION CERTIFICATE (9329th)

United States Patent
Alalu et al.

(10) Number: US 7,392,917 C1
(45) Certificate Issued: Oct. 3, 2012

(54) ROLL OF DISPOSABLE PIECES OF HYGIENIC PAPER

(75) Inventors: Avraham Alalu, Bnei Brak (IL); Gideon Sasonoff, Tel Aviv (IL)

(73) Assignee: Galileo Motzarei Niyar Ltd., Benai Brak (IL)

Reexamination Request:
No. 90/011,802, Aug. 17, 2011

Reexamination Certificate for:

| | |
|---|---|
| Patent No.: | **7,392,917** |
| Issued: | **Jul. 1, 2008** |
| Appl. No.: | **11/271,891** |
| Filed: | **Nov. 14, 2005** |

(51) Int. Cl.
*B65H 1/04* (2006.01)
(52) U.S. Cl. ..... 221/48; 242/597.8
(58) Field of Classification Search ..... None
See application file for complete search history.

(56) References Cited

To view the complete listing of prior art documents cited during the proceeding for Reexamination Control Number 90/011,802, please refer to the USPTO's public Patent Application Information Retrieval (PAIR) system under the Display References tab.

*Primary Examiner* — William Doerrler

(57) ABSTRACT

A roll of disposable pieces of hygienic paper from which pieces of hygienic paper can be removed with one hand without any need for tearing or cutting the hygienic paper, including an inner tube of a rigid material onto which pieces of hygienic paper are wound with partial overlapping between themselves. Pulling the next piece of hygienic paper in turn causes rotation of the roll of pieces of paper and easy removal of the piece from it. The roll of disposable pieces of hygienic paper can be assembled to a dispenser for carrying and use as well as a dispenser designed especially for the roll with means of exerting an adduction force on the roll.

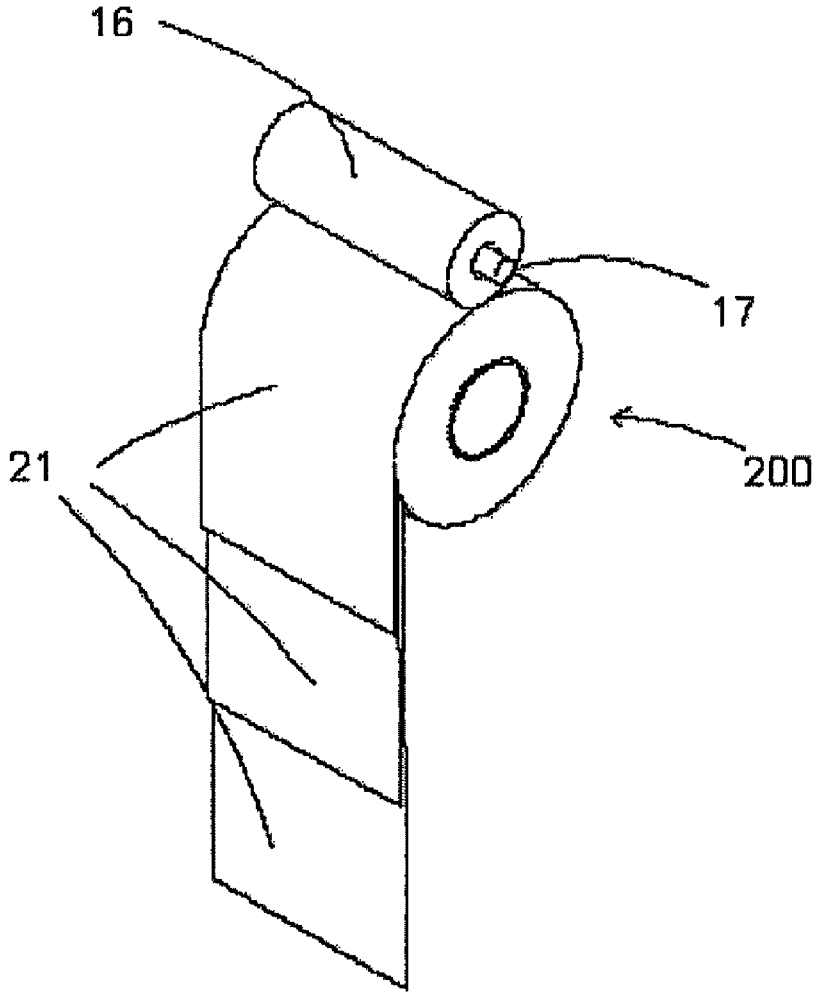

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 5 is confirmed.

Claims 1-4 and 6-8 are cancelled.

* * * * *